US008710912B2

(12) United States Patent
Marinca

(10) Patent No.: US 8,710,912 B2
(45) Date of Patent: Apr. 29, 2014

(54) SECOND ORDER CORRECTION CIRCUIT AND METHOD FOR BANDGAP VOLTAGE REFERENCE

(75) Inventor: Stefan Marinca, Limerick (IE)

(73) Assignee: Analog Device, Inc., Norwood, MA (US)

( * ) Notice: Subject to any disclaimer, the term of this patent is extended or adjusted under 35 U.S.C. 154(b) by 806 days.

(21) Appl. No.: 12/277,042

(22) Filed: Nov. 24, 2008

(65) Prior Publication Data

US 2010/0127763 A1 May 27, 2010

(51) Int. Cl.
*G05F 1/10* (2006.01)
*G05F 3/30* (2006.01)

(52) U.S. Cl.
CPC ..... *G05F 3/30* (2013.01)
USPC ..... 327/539

(58) Field of Classification Search
CPC ..... G05F 3/30
USPC ..... 327/362, 378, 512, 513, 538–541, 543; 323/312–317
See application file for complete search history.

(56) References Cited

U.S. PATENT DOCUMENTS 5,325,045 A 6/1994 Sundby
7,173,407 B2 * 2/2007 Marinca ..... 323/316
7,193,454 B1 * 3/2007 Marinca ..... 327/539
7,472,030 B2 * 12/2008 Scheuerlein ..... 702/99
7,579,898 B2 * 8/2009 Soldera et al. ..... 327/512
7,629,785 B1 * 12/2009 Drebinger ..... 323/313
2008/0074172 A1 3/2008 Marinca
2008/0197912 A1 * 8/2008 Pannwitz ..... 327/539
2009/0302822 A1 * 12/2009 Chao et al. ..... 323/313
2010/0073070 A1 * 3/2010 Ng et al. ..... 327/513

FOREIGN PATENT DOCUMENTS

EP 1359490 11/2003
WO WO 2004/077192 9/2004

OTHER PUBLICATIONS

International Preliminary Report on Patentability for PCT/US09/065634, mailed on Jun. 3, 2011.
Xingpen Xing, et al. "A low voltage high percision CMOS bandgap reference", NORCHIP, 2007, IEEE, Piscataway, NJ, USA.
International Search Report dated Mar. 24, 2010, in counterpart international application No. PCT/US2009/065634.

* cited by examiner

*Primary Examiner* — Sibin Chen
(74) *Attorney, Agent, or Firm* — Kenyon & Kenyon, LLP

(57) ABSTRACT

A system and method are provided for a more accurate bandgap voltage reference wherein the first and second order errors are corrected simultaneously. By using the components included in the correction of the first order error, the second order errors are corrected, advantageously providing less process variability.

18 Claims, 4 Drawing Sheets

700

SECOND ORDER CORRECTION CIRCUIT AND METHOD FOR BANDGAP VOLTAGE REFERENCE

COPYRIGHT AND LEGAL NOTICES

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

FIELD OF THE INVENTION

The present invention relates generally to voltage references and in particular to voltage references implemented using bandgap circuitry. The present invention more particularly relates to a circuit and method which provides a reference voltage which compensates for typical second order voltage error.

BACKGROUND

A conventional bandgap voltage reference circuit is based on the addition of two voltage components having opposite and balanced temperature slopes.

FIG. 1 illustrates a symbolic representation of a conventional bandgap reference. It consists of a current source, 110, a resistor, 120, and a diode, 130. It will be understood that the diode represents the base-emitter junction of a bipolar transistor. The voltage drop across the diode has a negative temperature coefficient, TC, of about −2.2 mV/° C. and is usually denoted as a Complementary to Absolute Temperature (CTAT) voltage, since its output value decreases with increasing temperature. This voltage has a typical negative temperature coefficient according to equation 1 below:

$$V_{be}(T) = V_{G0}\left(1 - \frac{T}{T_0}\right) + V_{be}(T_0) * \frac{T}{T_0} - \underbrace{\sigma * \frac{KT}{q} * \ln\left(\frac{T}{T_0}\right)}_{\text{Nonlinearity component A}} + \underbrace{\frac{KT}{q} * \ln\left(\frac{Ic(T)}{Ic(T_0)}\right)}_{\text{Nonlinearity component B}} \quad \text{(Eq. 1)}$$

Here, $V_{G0}$ is the extrapolated base emitter voltage at zero absolute temperature, of the order of 1.2V; T is actual temperature; $T_0$ is a reference temperature, which may be room temperature (i.e. T=300K); $V_{be}(T_0)$ is the base-emitter voltage at $T_0$, which may be of the order of 0.7V; σ is a constant related to the saturation current temperature exponent, which is process dependent and may be in the range of 3 to 5 for a CMOS process; K is the Boltzmann's constant, q is the electron charge, $I_c(T)$ and $I_c(T_0)$ are corresponding collector currents at actual temperatures T and $T_0$, respectively.

The current source 110 in FIG. 1 is desirably a Proportional to Absolute Temperature (PTAT) source, such that the voltage drop across r1 is PTAT voltage. As absolute temperature increases, the voltage output increases as well. The PTAT current is generated by reflecting across a resistor a voltage difference ($\Delta V_{be}$) of two forward-biased base-emitter junctions of bipolar transistors operating at different current densities. The difference in collector current density may be established from two similar transistors, i.e. Q1 and Q2 (not shown), where Q1 is of unity emitter area and Q2 is n times unity emitter area. The PTAT current or voltage is generated by reflecting across a resistor a voltage difference ($\Delta V_{be}$) of the two forward-biased base-emitter junctions of transistors Q1 and Q2. The resulting $\Delta V_{be}$, which has a positive temperature coefficient, is provided in equation 2 below:

$$\Delta V_{be} = V_{be}(Q_1) - V_{be}(Q_2) = \frac{KT}{q} * \ln(n) \quad \text{(Eq. 2)}$$

FIG. 2 illustrates the operation of the circuit of FIG. 1. By combining the CTAT voltage, V_CTAT of diode 130 with the PTAT voltage, V_PTAT, from the voltage drop across resistor 120, it is possible to provide a relatively constant output voltage Vref over a wide temperature range (i.e. −50° C. to 125° C.). This base-emitter voltage difference, at room temperature, may be of the order of 50 mV to 100 mV for n from 8 to 50. To balance the voltage components of the negative temperature coefficient from equation 1 and the positive temperature coefficient of equation 2 a gain factor is required. This gain factor may be in the order of five to ten. The balancing of the two voltage components is known as "first order error correction." Even if the two voltage components are well balanced, the corresponding reference voltage is not entirely flat over temperature as second order nonlinearity components A and B of equation 1 are not compensated. Nonlinearity components contribute to what is known as "curvature."

Different methods are known to compensate for "curvature" errors. In U.S. Pat. No. 4,443,753 to McGlinchey, a correction current is given in the form of equation 3 below:

$$\text{I_corr} = \frac{KT}{q}\ln\left(\frac{T}{T_0}\right) \quad \text{(Eq. 3)}$$

The correction current is generated from a voltage difference of two bipolar transistors, having the same emitter area, one biased with PTAT current and one with CTAT current. This correction current, proportional to a differential gain stage, is then subtracted from a Brokaw cell in order to compensate for the "curvature" error.

There are many similar methods and circuits adopted to compensate for second order temperature effects in bandgap voltage references. One issue with the prior approaches includes the compensation component, proportional to σ, in nonlinearity component A of equation 1, which is very strongly dependent on process parameters. One circuit with less process dependency is disclosed in US Patent Application Publication No. US 2008/0074172, to the same inventor as the present invention. In order to correct the second order errors, typically additional circuitry is introduced which adds to the process variability, size, and complexity of the bandgap reference design.

BRIEF DESCRIPTION OF THE DRAWINGS

The invention is illustrated in the figures of the accompanying drawings, which are meant to be exemplary and not limiting, and in which like references are intended to refer to like or corresponding parts.

DETAILED DESCRIPTION

A system and method are provided for a more accurate bandgap voltage reference wherein the first and second order errors are corrected simultaneously. By using the components included in the correction of the first order error, the second order errors are corrected, advantageously providing less process variability.

Figure 3:
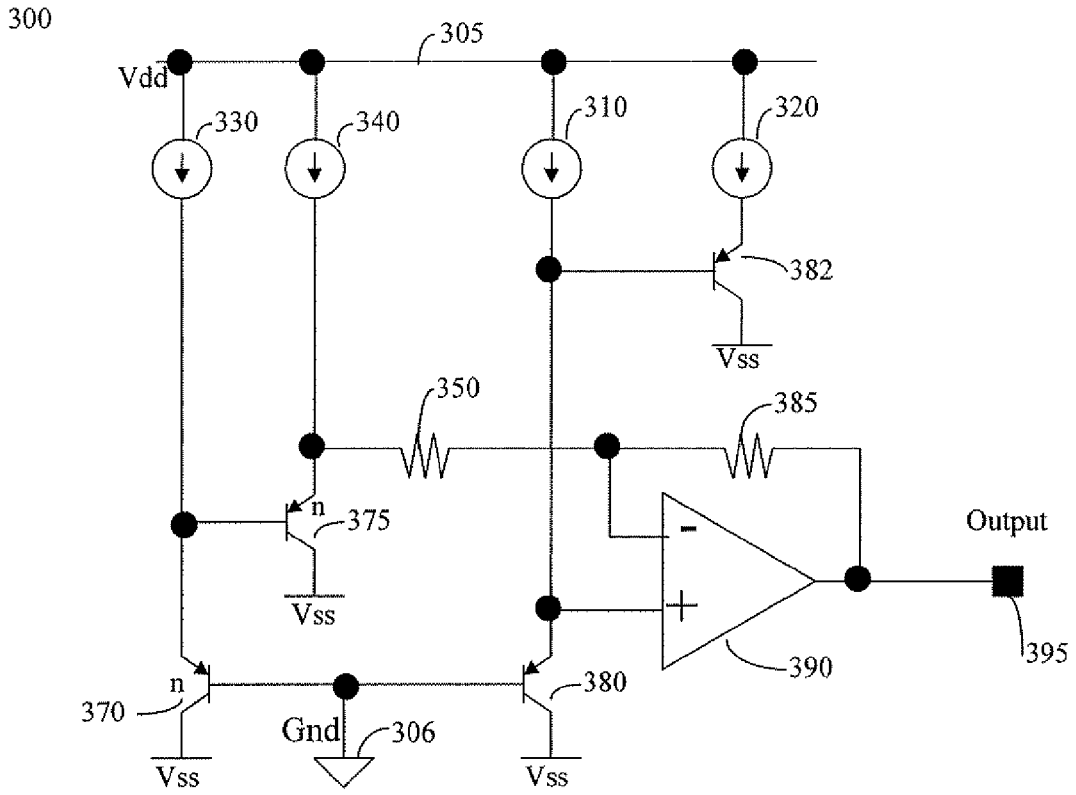
FIG. 3 shows an embodiment of the present invention.

The bandgap reference circuit of FIG. 3 is an embodiment of the present invention. This circuit includes a first set of circuit elements arranged to provide a complimentary to absolute temperature (CTAT) voltage or current. For example, the first set of circuit elements may comprise transistors 370 and 375, which are supplied by current sources 330 and 340 accordingly. A second set of circuit elements are arranged to provide a proportional to absolute temperature (PTAT) voltage or current. For example, the second set of circuit elements may comprise at least transistor 380, which is supplied by current source 310, and of first resistance 350. For a more accurate matching of emitter currents in transistors 370 and 380, transistor 382 may be included. By transistor 382 drawing base current similar to the base current drawn by transistor 375, the emitter currents supplied to transistors 370 and 380 more closely match.

Transistors 370 and 375 of the first set of circuit elements have emitter areas n times larger than transistors 380 and 382 of the second set of circuit elements. Thus, if the current sources 310, 320, 330, and 340 provide the same current, and the current through 350 can be neglected, transistors 380 and 382 operate at n times the current density of transistors 370 and 375.

A third set of circuit elements are arranged to combine the CTAT voltage or current with the PTAT voltage or current. For example, the third set of circuit elements may comprise amplifier 390 and a second resistance 385. Since there is a virtual short across the positive and negative terminals of amplifier 390, the Vbe of transistor 380 is seen at both the positive and negative terminals of amplifier 390. Accordingly, one terminal of resistance 350 is at Vbe from transistor 380 while the transistor stack of 370 and 375 provides 2Vbe at the opposite terminal of resistance 350. Thus, amplifier 390 combines the CTAT component of transistors 370 and 375 and the ΔVbe component across resistance 350 to create the bandgap reference voltage at output 395.

The ratio of second resistance 385 to first resistance 350 controls the output gain of amplifier 390. As provided in the context of the discussion of equation 2, amplifier 390 can provide the gain to balance the two voltage components of Vbe and $\Delta V_{be}$. The specific ratio of the second resistance 385 to the first resistance 350 provides a gain that may be used in balancing the two voltage components of Vbe and $\Delta V_{be}$. This balancing can accommodate the first order errors. The calculations below provide further insight:

$$\Delta V_{be}=V_{be}(Q_1)-V_{be}(Q_n) \quad \text{(Eq. 4)}$$

Thus, $$V_{be}(Q_n)=V_{be}(Q_1)-\Delta V_{be} \quad \text{(Eq. 5)}$$

Where Q1 is transistor 380;

$Q_n$ is a transistor having n times emitter width (i.e. transistor 370 or 375).

Since the embodiment in FIG. 3 comprises a stack of two transistors 370 and 375 which have an emitter width n times that of transistor 380, the voltage across resistance 350 is:

$$V_{r1}=2V_{be}(Q_1)-2\Delta V_{be}-V_{be}(Q_1) \quad \text{(Eq. 6)}$$

Thus, $$V_{r1}=V_{be}(Q_1)-2\Delta V_{be} \quad \text{(Eq. 7)}$$

The $V_{be}(Q_1)$ component may be of the order of 600 mV to 700 mV. $\Delta V_{be}$, on the other hand, is only about 100 mV. Accordingly, a gain factor is required to balance the two voltage components. The ratio of second resistance 385 to first resistance 350 controls the output gain of amplifier 390. Equation 8 below provides the reference voltage at output 395 taking the gain factor into consideration.

$$V_{ref} = V_{be}(Q_1) + \frac{r_2}{r_1}2 * \frac{KT}{q} * \ln(n) \quad \text{(Eq. 8)}$$

Where $V_{ref}$ is the voltage at output 395;

$Q_1$ is transistor 380;

$r_1$ is resistance 350;

$r_2$ is resistance 385.

In one embodiment, current sources 310, 320, 330, and 340 are assumed to be generated from the emitter voltage difference of transistors 382 and 380 on the one hand, and 375 and 370, on the other, reflected across a resistance $r_0$ (not shown). These bias currents are assumed to be the same, as provided in equation 9 below:

$$I_1 = I_2 = I_3 = \frac{2\Delta V_{be0} * \frac{T}{T_0}}{r_0} = I_0 * \frac{T}{T_0} \quad \text{(Eq. 9)}$$

Where $I_1$ is the current through source 310;

$I_2$ is the current through source 320;

$I_3$ is the current through source 330.

The bias current 340, which is denoted as $I_4$ in subsequent equations, supplies the currents to the emitter of transistor 375 and resistance 350. In one embodiment, the bias current 340 may have the same temperature dependency as bias currents 310, 320, and 330 such that at room temperature ($T_0$) all bipolar transistors (370, 375, 380, and 382) are operating at substantially the same emitter currents. Advantageously, under this condition the base current effect on bipolar transistor stack (i.e. transistors 370 and 375) is minimized. For any other temperature, the emitter current of transistor 375 may differ from those of transistors 310, 320, and 330 as the current through resistance 350 is a shifted CTAT, as provided by equation 10 below:

$$I(r_1) = \frac{V_{be}(Q_3) + V_{be}(Q_4) - V_{be}(Q_1)}{r_1} \quad \text{(Eq. 10)}$$

Where, with respect to FIG. 3, $r_1$ is resistance 350;

$Q_1$ is transistor 380;

$Q_3$ is transistor 370;

$Q_4$ is transistor 375.

At room temperature (T0) the current $I(r_1)$ is given in equation 11 below:

$$I(r_1)_{T=T0} = \frac{V_{be10} - 2\Delta V_{be0}}{r_1} \quad \text{(Eq. 11)}$$

The current I4 at $T_0$ is given in equation 12 below:

$$I_4(T = T_0) = \frac{2\Delta V_{be0}}{r_0} + \frac{V_{be10} - 2\Delta V_{be0}}{r_1} \quad \text{(Eq. 12)}$$

For a different temperature, T, this current is given in equation 13 below:

$$I_4(T) = \left(\frac{2\Delta V_{be0}}{r_0} + \frac{V_{be10} - 2\Delta V_{be0}}{r_1}\right) * \frac{T}{T_0} \quad \text{(Eq. 13)}$$

Figure 4:
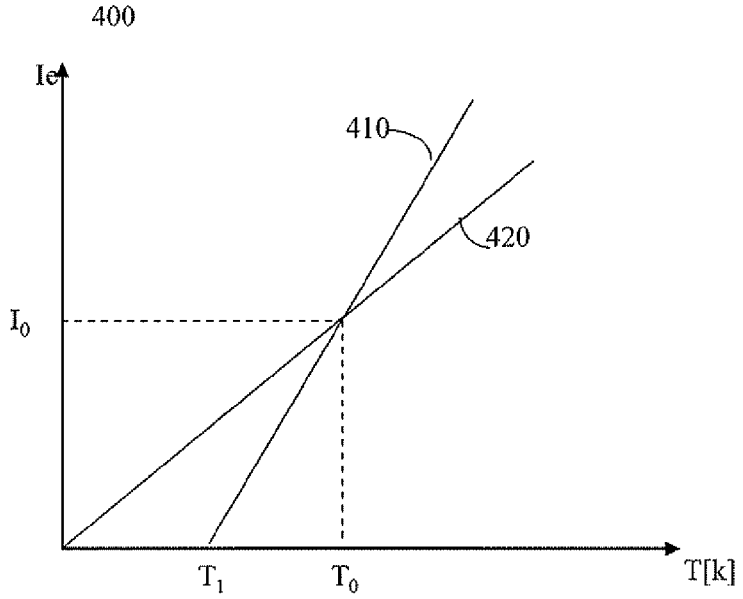
FIG. 4 is a graphical representation of how the ratio of the first resistance to the second resistance in FIG. 3 may compensate for the second order error of the bandgap reference voltage.

It will be understood that $I_4$, the current through the emitter of $Q_4$ plus the current through r1, is PTAT current, and $I(r_1)$, the current through resistance $r_1$, is shifted CTAT current. The current through the emitter of Q4 is shifted PTAT. The larger the current through resistance $r_1$ in relation to the current through the emitter of transistor $Q_4$, the larger the slope of the shifted PTAT current. FIG. 4 illustrates the emitter current of Q4 (410) in relation to the emitter current of $Q_1$, $Q_2$, $Q_3$, and $Q_4$ (420). This shifted PTAT response is provided in equation 14 below:

$$I(Q_4, e) = I_0 * \frac{T - T_1}{T_0 - T_1} \quad \text{(Eq. 14)}$$

At $T=T_1$ the current through the emitter of Q4 is zero. The parameter $T_1$ is set by the $r_1/r_0$ ratio to compensate for the second order error for the reference voltage.

According to equation 1 the base-emitter voltages of transistors Q1, Q2, Q3, and Q4 (as illustrated in FIG. 3 to be 380, 382, 370, and 375 accordingly), can be described by the following relationships:

$$V_{be}(Q_1) = V_{G0}\left(1 - \frac{T}{T_0}\right) + V_{be10}(T_0) * \frac{T}{T_0} - (\sigma - 1) * \frac{KT}{q} * \ln\left(\frac{T}{T_0}\right) \quad \text{(Eq. 15)}$$

$$V_{be}(Q_2) = V_{G0}\left(1 - \frac{T}{T_0}\right) + V_{be20}(T_0) * \frac{T}{T_0} - (\sigma - 1) * \frac{KT}{q} * \ln\left(\frac{T}{T_0}\right) \quad \text{(Eq. 16)}$$

$$V_{be}(Q_3) = V_{G0}\left(1 - \frac{T}{T_0}\right) + V_{be30}(T_0) * \frac{T}{T_0} - (\sigma - 1) * \frac{KT}{q} * \ln\left(\frac{T}{T_0}\right) \quad \text{(Eq. 17)}$$

$$V_{be}(Q_4) = V_{G0}\left(1 - \frac{T}{T_0}\right) + V_{be40}(T_0) * \frac{T}{T_0} - \sigma * \frac{KT}{q} * \ln\left(\frac{T}{T_0}\right) + \frac{KT}{q} * \ln\left(\frac{T - T_1}{T_0 - T_1}\right) \quad \text{(Eq. 18)}$$

Here $V_{be10}$, $V_{be20}$, $V_{be30}$, and $V_{be40}$ are the corresponding base-emitter voltages at reference or room temperature, $T_0$, and $\sigma$ is the saturation current temperature exponent.

The reference voltage at the amplifier's output 395 is provided in equation 19 below:

$$V_{ref} = -\frac{r_2}{r_1} * [V_{be}(Q_3) + V_{be}(Q_4)] + \left(1 + \frac{r_2}{r_1}\right) * V_{be}(Q_1) \quad \text{(Eq. 19)}$$

$$V_{ref} = V_{G0} * \left(1 - \frac{T}{T_0}\right) * \left(1 - \frac{r_2}{r_1}\right) + V_{be10} * \frac{T}{T_0} * \left(1 - \frac{r_2}{r_1}\right) + 2\Delta V_{be0} * \frac{T}{T_0} - \left[\sigma * \left(1 - \frac{r_2}{r_1}\right) - 1\right] * \frac{KT_0}{q} * \frac{T}{T_0} * \ln\left(\frac{T}{T_0}\right) - \frac{r_2}{r_1} * \frac{KT_0}{q} * \frac{T}{T_0} * \ln\left(\frac{T - T_1}{T_0 - T_1}\right) \quad \text{(Eq. 20)}$$

Using Taylor approximations up to the second order for two logarithmic expressions of equation 20, the expression in equation 21 below results:

$$V_{ref} = A + B * \frac{T}{T_0} + C * \left(\frac{T}{T_0}\right)^2 \quad \text{(Eq. 21)}$$

Where A is a constant:

$$A = V_{G0} * \left(1 - \frac{r_2}{r_1}\right) + \frac{1}{2} * \frac{KT_0}{q} * \left[\sigma * \left(1 - \frac{r_2}{r_1}\right) - 1 + \frac{r_2}{r_1} * \frac{1}{\left(1 - \frac{T_1}{T_0}\right)^2}\right] \quad \text{(Eq. 22)}$$

B and C represent the temperature dependent component:

$$B = -(V_{G0} - V_{be10}) * \left(1 - \frac{r_2}{r_1}\right) + 2 * \frac{r_2}{r_1} * \Delta V_{be0} - \frac{r_2}{r_1} * \frac{KT_0}{q} * \frac{\frac{T_1}{T_0}}{\left(1 - \frac{T_1}{T_0}\right)^2} \quad \text{(Eq. 23)}$$

$$C = \frac{1}{2} * \frac{KT_0}{q} * \left[1 - \sigma * \left(1 - \frac{r_2}{r_1}\right) + \frac{r_2}{r_1} * \frac{1 - 2 * \frac{T_1}{T_0}}{\left(1 - \frac{T_1}{T_0}\right)^2}\right] \quad \text{(Eq. 24)}$$

In one embodiment, in order to compensate the first and second order voltage errors simultaneously, the coefficients B and C both should be zero. In this regard, setting B=C=0, two parameters can be extracted from equations 23 and 24, namely $r_2/r_1$ and $T_1/T_0$. For example, using an iterative approach, one can neglect the last term of equation 23 to calculate the following:

$$\frac{r_2}{r_1} = \frac{1}{1 + \frac{2 * \Delta V_{be0}}{V_{G0} - V_{be10}}} \quad \text{(Eq. 25)}$$

The ratio $T_1/T_0$ may then be calculated from C=0 using $r_2/r_1$ from equation 25 above.

In the second step, r2/r1 may be calculated more accurately from equation 23 using the calculated value for T1/T0.

For example for a submicron CMOS process with $V_{G0}$=1.14V, $V_{be10}$=0.687V; $\Delta V_{be0}$=87.2 mV, XTI=4.8, the two calculated parameters, $r_2/r_1$, and $T_1/T_0$ are:

$$\frac{r_2}{r_1} = 0.79; \frac{T_1}{T_0} = 0.47 \quad \text{Eq. 26)}$$

Applying these values to equation 22, $V_{ref}$ can be calculated:

$$V_{ref}=A=0.2825V \quad \text{(Eq. 27)}$$

Figure 1:
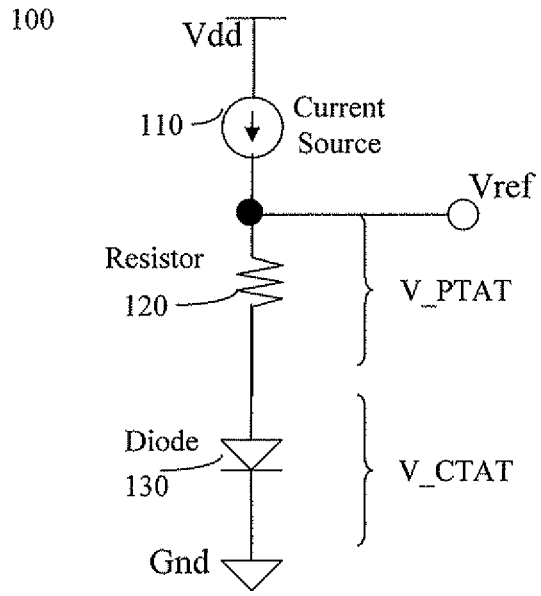
Fig. 1 Prior Art
FIG. 1 shows a known bandgap voltage reference circuit.
Figure 2:
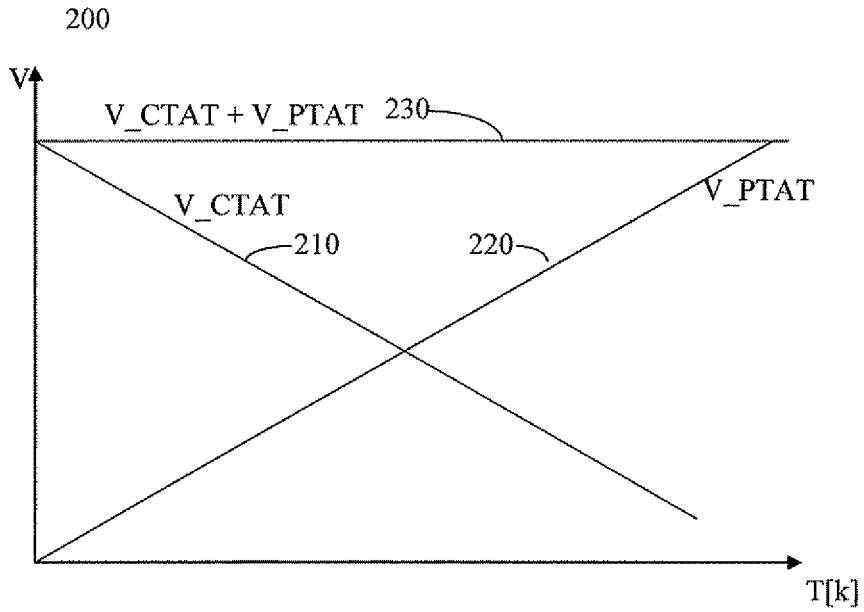
Fig. 2 Prior Art
FIG. 2 is a graph that illustrates how PTAT and CTAT voltages generated through the circuit of FIG. 1 may be combined to provide a reference voltage.
Figure 5:
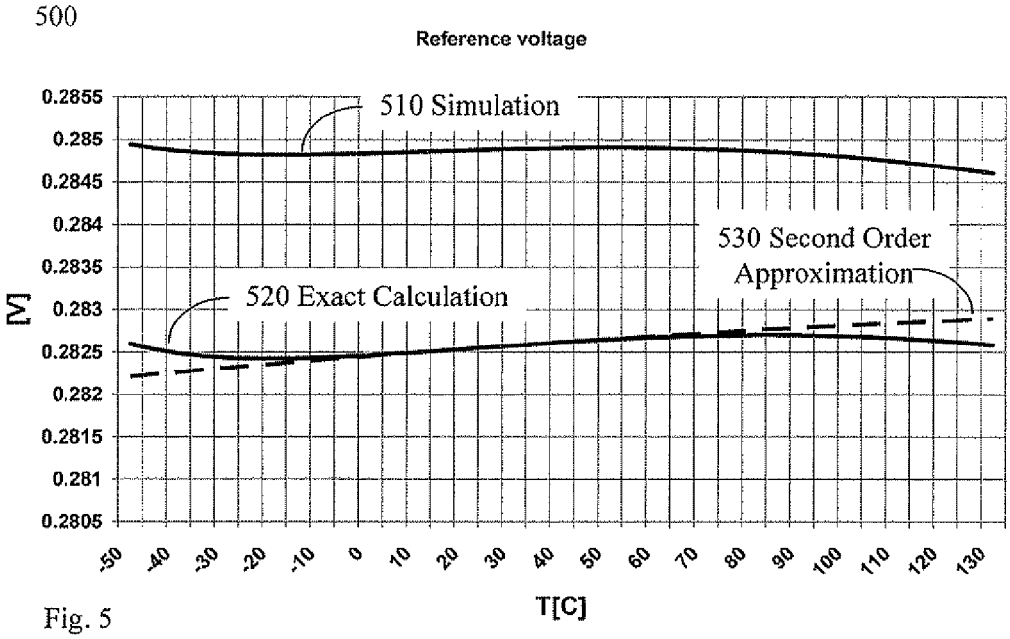
FIG. 5 is a graphical representation of the simulated, calculated, and second order approximation of the bandgap reference voltage over temperature, in accordance with an embodiment of the present invention.

FIG. 5 provides three reference voltage plots. Plot 510 represents the simulated voltage reference with respect to the embodiment illustrated in FIG. 1. Plot 520 represents an exact calculation based on equation 20 above. Plot 530 represents the second order approximation according to equations 21 to 24. As illustrated in FIG. 5, in this embodiment, the simulated response 510 is within 1% of the exact calculation 520 and the second order approximation 530. Further, all three diagrams show that the curvature due to the T(logT) error is compensated. For the industrial temperature range (−40° C. to 85° C.) the total deviation of simulated voltage reference is about 82 uV, which corresponds to a thermal coefficient (TC) of 2.3 ppm/° C. Accordingly, this exemplary embodiment is validated as well as the different approaches in calculating and simulating the output reference voltage.

Figure 6:
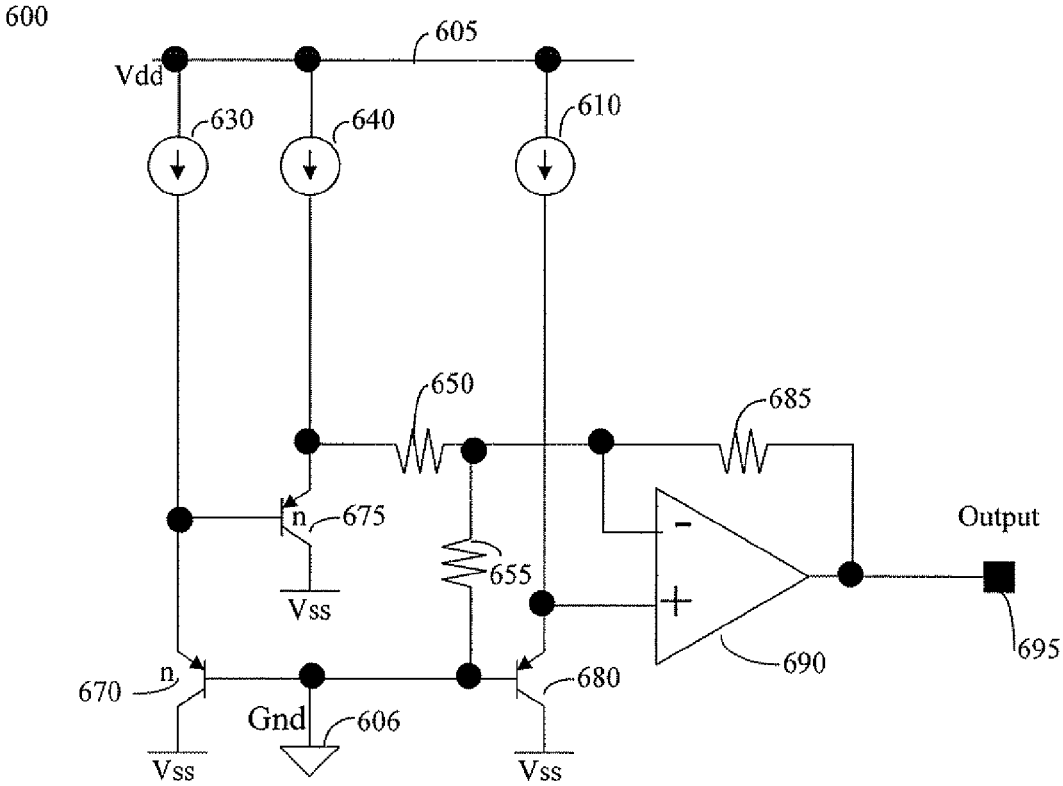
FIG. 6 shows an embodiment of the present invention wherein the output voltage has an extra CTAT component.

FIG. 6 shows an embodiment of the present invention with a corrected higher reference voltage. This circuit includes a first set of circuit elements arranged to provide a CTAT voltage or current. For example, the first set of circuit elements may comprise transistors 670 and 675, which are supplied by current sources 630 and 640 accordingly. Further, resistance 655 includes the purpose of advantageously increasing the output voltage by injecting an extra CTAT component into feedback resistance 685.

A second set of circuit elements are arranged to provide a PTAT voltage or current. For example, they may comprise at least transistor 680 which is supplied by current source 610, and a first resistance 650. Transistors 670 and 675 of the first set of circuit elements have emitter areas n times that of transistor 680 of the second set of circuit elements. Thus, if the current sources 610, 630 and 640 provide the same current, transistor 680 operates at a current density n times the current density of transistors 670 and 675.

A third set of circuit elements are arranged to combine the CTAT voltage or current with the PTAT voltage or current. In the embodiment of FIG. 6, the third set of circuit elements may comprise amplifier 690 and a second resistance 685. The principles provided in the discussion of FIG. 3 largely apply to this circuit as well. However, due to resistance 655, an extra CTAT component is injected into the feedback resistance 685, thereby increasing the output voltage 695.

Figure 7:
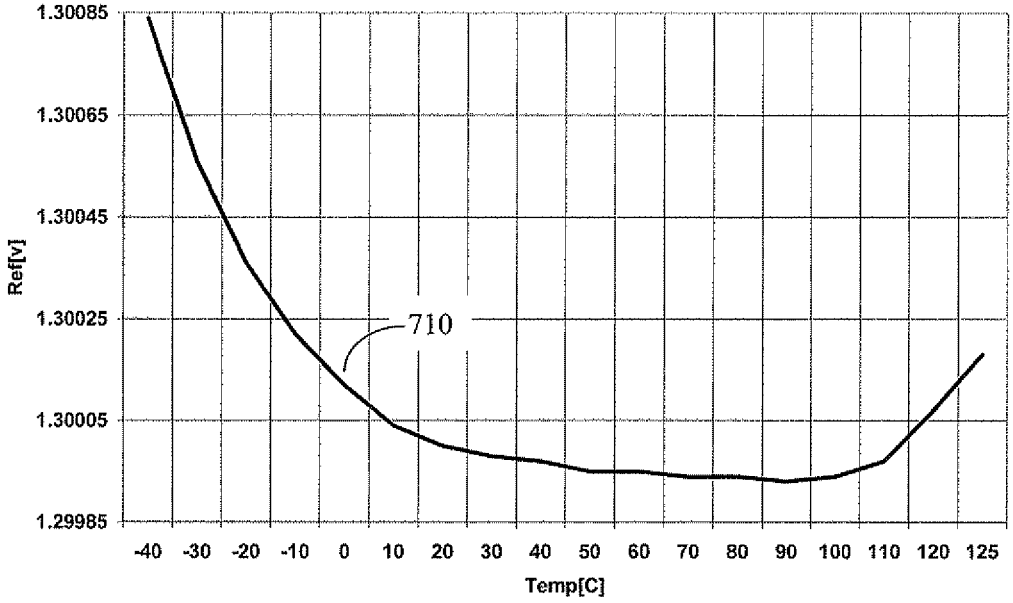
FIG. 7 is a graphical representation of the voltage reference output voltage vs. temperature in accordance with the embodiment of FIG. 6.

Similar to the calculations provided in the context of determining the resistance values of FIG. 3, one can find the ratios of the three resistances for which the curvature error is compensated. FIG. 7 illustrates a reference voltage vs. temperature of a circuit according to the principles embodied in the circuit of FIG. 6. Graph 710 illustrates the curvature error is only marginally overcorrected and are mainly attributable to simulation tolerances. In one embodiment the resulting temperature coefficient of the reference voltage of FIG. 7 is about 4 ppm/° C. for the temperature ranging from −40° C. to 125° C.

Those skilled in the art will readily understand that the concepts described above can be applied with different devices and configurations. Although the present invention has been described with reference to particular examples and embodiments, it is understood that the present invention is not limited to those examples and embodiments. The present invention as claimed, therefore, includes variations from the specific examples and embodiments described herein, as will be apparent to one of skill in the art. For example, diodes or NPN transistors can be used instead of the PNP transistors. Accordingly, it is intended that the invention be limited only in terms of the appended claims.

What is claimed is:

1. A bandgap voltage reference circuit configured to provide a voltage reference at an output thereof, the circuit comprising:

a first set of circuit elements, including at least one bi-polar transistor and a first resistor connected to an emitter of the at least one bi-polar transistor, the first set of circuit elements arranged to provide a complimentary to absolute temperature (CTAT) voltage or current;

a second set of circuit elements, the second set of circuit elements arranged to provide a proportional to absolute temperature (PTAT) voltage or current, such that at absolute zero temperature its polarity is opposite to that of the complementary to absolute temperature voltage or current provided by the first set of circuit elements; and a third set of circuit elements, including an amplifier and a second resistor that provides a feedback path between an output and an input of the amplifier, the amplifier arranged to combine the CTAT voltage or current with the PTAT voltage or current so as to generate the voltage reference;

wherein a ratio of a resistance of the first resistor to a resistance of the second resistor is selected to compensate for first order errors of the voltage reference, and a ratio of a temperature at which a current through the emitter of the at least one bi-polar transistor is zero to room temperature is determined, as a function of the ratio of the resistance of the first and the second resistors, to compensate for second order errors of the voltage reference, so that the first and second order errors of the voltage reference are simultaneously compensated.

2. The bandgap voltage reference circuit according to claim 1, wherein the second set of circuit elements include at least one bipolar transistor.

3. The bandgap voltage reference circuit according to claim 2, wherein the first set of circuit elements include at least one bipolar transistor operated at n (n≥1) times a current density of the at least one bipolar transistor of the second set of circuit elements.

4. The bandgap voltage reference circuit according to claim 3, wherein the CTAT voltage is generated by a total emitter to base voltage of the at least one bipolar transistor of the first set of circuit elements.

5. The bandgap voltage reference circuit according to claim 3, wherein the transistors of the first and second circuit elements are operated at substantially the same emitter currents when at room temperature.

6. The bandgap voltage reference circuit according to claim 2, wherein the first set of circuit elements include at least a stack of two transistors, each having an emitter width n (n≥1) times the at least one bipolar transistor of the second set of circuit elements.

7. The bandgap voltage reference circuit according to claim 1, wherein an output voltage is increased by injecting an extra CTAT component into the second resistor.

8. The bandgap voltage reference circuit according to claim 7, wherein a third resistor connected between the first resistor and ground provides the extra CTAT component.

9. A method of providing a bandgap voltage reference configured to provide a voltage reference at an output thereof, the method comprising:

providing a first set of circuit elements, including at least one bi-polar transistor and a first resistor connected to an emitter of the at least one bi-polar transistor, the first set of circuit elements arranged to provide a complimentary to absolute temperature (CTAT) voltage or current;

providing a second set of circuit elements, the second set of circuit elements arranged to provide a proportional to absolute temperature (PTAT) voltage or current, such that at absolute zero temperature its polarity is opposite to that of the complementary to absolute temperature voltage or current provided by the first set of circuit elements;

providing a third set of circuit elements, including an amplifier and a second resistor that provides a feedback path between an output and an input of the amplifier, the amplifier arranged to combine the CTAT voltage or current with the PTAT voltage or current so as to generate the voltage reference;

determining a ratio of the resistance of the first resistor to the resistance of the second resistor to compensate for first order errors of the voltage reference; and determining a ratio of a temperature at which a current through an emitter of the at least one bi-polar transistor is zero to room temperature, as a function of the ratio of the resistances of the first and the second resistors, to compensate for second order errors of the voltage reference, so that the first and second order errors of the voltage reference are simultaneously compensated.

10. The method according to claim 9, wherein the second set of circuit elements include at least one bipolar transistor.

11. The method according to claim 10, wherein the second set of circuit elements include at least one bipolar transistor operated at n (n≥1) times a current density of the at least one bipolar transistor of the first set of circuit elements.

12. The method according to claim 11, wherein the CTAT voltage is generated by a total emitter to base voltage of the at least one bipolar transistor of the first set of circuit elements.

13. The method according to claim 11, wherein the transistors of the first and second circuit elements are operating at substantially the same emitter currents at room temperature.

14. The method according to claim 10, wherein the first set of circuit elements include at least a stack of two transistors, each having an emitter width n (n≥1) times the at least one bipolar transistor of the first set of circuit elements.

15. The method according to claim 9, wherein an output voltage is increased by injecting an extra CTAT component into the second resistor.

16. The method according to claim 15, wherein a third resistor connected between the first resistor and ground provides the extra CTAT component.

17. A bandgap voltage reference circuit configured to provide a voltage reference at an output thereof, the circuit comprising:

a first set of circuit elements arranged to provide a complimentary to absolute temperature (CTAT) voltage or current, wherein the first set of circuit elements include a stack of two bi-polar transistors, wherein a second of the stack of two bi-polar transistors is coupled to a first resistance element;

a second set of circuit elements arranged to provide a proportional to absolute temperature (PTAT) voltage or current, wherein the second set of circuit elements include one bipolar transistor operated at n (n≥1) times a current density of each of the stack of two bi-polar transistors of the first set of circuit elements;

an amplifier with a negative feedback network arranged to combine the CTAT voltage or current with the PTAT voltage or current so as to generate the voltage reference, wherein the negative feedback of the amplifier network includes a second resistance element, and wherein a negative terminal of the amplifier is coupled to the stack of two bi-polar transistors from the first set of circuit elements in series with the first resistance element;

a first bias current supplying current to the second of the stack of two bi-polar transistors of the first set of circuit elements; and a second bias current supplying current to the transistor of the second set of circuit elements, wherein the first and second bias currents are current mirrors from a common current source, and wherein a ratio of the resistance of the first resistance element to the resistance of the second resistance element is selected to compensate for first order errors of the voltage reference, and a ratio of a temperature at which a current through an emitter of the second of the stack of two bi-polar transistors is zero to room temperature is determined, as a function of the ratio of the resistances of the first and the second resistance elements, to compensate for second order errors of the voltage reference, so that the first and second order errors of the voltage reference are simultaneously compensated.

18. The bandgap voltage reference circuit according to claim 17, wherein the common current source for the first and second bias currents is a PTAT current source.

* * * * *

UNITED STATES PATENT AND TRADEMARK OFFICE

CERTIFICATE OF CORRECTION

PATENT NO. : 8,710,912 B2
APPLICATION NO. : 12/277042
DATED : April 29, 2014
INVENTOR(S) : Stefan Marinca It is certified that error appears in the above-identified patent and that said Letters Patent is hereby corrected as shown below:

In the Claims

Claim 3, Column 8, line 64, change:

"wherein the first set" to -- wherein the second set --;

Claim 3, Column 8, line 66, change:

"transistor of the second set" to -- transistor of the first set --;

Claim 14, Column 10, line 7, change:

"transistor of the first set" to -- transistor of the second set --.

Signed and Sealed this
Thirtieth Day of December, 2014

Michelle K. Lee

Michelle K. Lee
*Deputy Director of the United States Patent and Trademark Office*